US009711016B2

(12) United States Patent
Spina

(10) Patent No.: US 9,711,016 B2
(45) Date of Patent: Jul. 18, 2017

(54) HAZARD DETECTION ASSEMBLY

(71) Applicant: Peter Spina, Marco Island, FL (US)

(72) Inventor: Peter Spina, Marco Island, FL (US)

( * ) Notice: Subject to any disclaimer, the term of this patent is extended or adjusted under 35 U.S.C. 154(b) by 0 days.

(21) Appl. No.: 14/921,407

(22) Filed: Oct. 23, 2015

(65) Prior Publication Data

US 2017/0116826 A1 Apr. 27, 2017

(51) Int. Cl.

| | |
|---|---|
| ***G08B 7/06*** | (2006.01) |
| ***G08B 17/10*** | (2006.01) |
| ***G08B 13/02*** | (2006.01) |
| *G08B 19/00* | (2006.01) |
| *G08B 13/196* | (2006.01) |

(52) U.S. Cl.

CPC ..... *G08B 7/06* (2013.01); *G08B 13/02* (2013.01); *G08B 17/10* (2013.01); *G08B 13/19695* (2013.01); *G08B 19/005* (2013.01)

(58) Field of Classification Search

CPC ..... G08B 19/005; G08B 17/00; G08B 17/10; G08B 13/19695; G08B 25/009; F21V 33/0076; H01R 13/717; H02G 3/20

See application file for complete search history.

(56) References Cited

U.S. PATENT DOCUMENTS

| | | | | |
|---|---|---|---|---|
| 4,090,178 | A | 5/1978 | Norris | |
| 4,365,237 | A | 12/1982 | Knight | |
| 4,419,658 | A | 12/1983 | Jarosz et al. | |
| 4,812,827 | A | 3/1989 | Scripps | |
| 4,896,145 | A * | 1/1990 | Lewkowicz | F21V 33/0076 307/66 |
| 4,949,077 | A | 8/1990 | Mbuthia | |
| 5,396,221 | A | 3/1995 | Bridges | |
| 7,649,472 | B1 * | 1/2010 | Paterno | F21V 33/0076 307/116 |
| 7,990,252 | B2 | 8/2011 | Barton | |
| 9,460,596 | B1 * | 10/2016 | Moses | H04N 7/14 |
| 2008/0291036 | A1 * | 11/2008 | Richmond | G08B 17/10 340/628 |
| 2009/0072970 | A1 * | 3/2009 | Barton | F21S 9/022 340/540 |

* cited by examiner

*Primary Examiner* — Mirza Alam

(57) ABSTRACT

A hazard detection assembly includes a lamp that may be positioned on a support surface. A smoke alert is movably coupled to the lamp. The smoke alert is selectively extended from the lamp such that the smoke alert may detect smoke. The smoke alert issues an audible alarm when the smoke alert detects the smoke. A security alert is coupled to the lamp and the security alert detects motion. The security alert issues an audible alarm when the security alert detects the motion. A control is coupled to the lamp and the control may be manipulated. The control is electrically coupled to the smoke alert and the security alert such that the control controls operational parameters of the smoke alert and the security alert. A remote control is in electrical communication with security alert such that the remote control controls operational parameters of the security alert.

13 Claims, 5 Drawing Sheets

HAZARD DETECTION ASSEMBLY

BACKGROUND OF THE DISCLOSURE

Field of the Disclosure

The disclosure relates to detection devices and more particularly pertains to a new detection device for issuing an audible smoke alarm and an audible motion alarm.

SUMMARY OF THE DISCLOSURE

An embodiment of the disclosure meets the needs presented above by generally comprising a lamp that may be positioned on a support surface. A smoke alert is movably coupled to the lamp. The smoke alert is selectively extended from the lamp such that the smoke alert may detect smoke. The smoke alert issues an audible alarm when the smoke alert detects the smoke. A security alert is coupled to the lamp and the security alert detects motion. The security alert issues an audible alarm when the security alert detects the motion. A control is coupled to the lamp and the control may be manipulated. The control is electrically coupled to the smoke alert and the security alert such that the control controls operational parameters of the smoke alert and the security alert. A remote control is in electrical communication with security alert such that the remote control controls operational parameters of the security alert.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
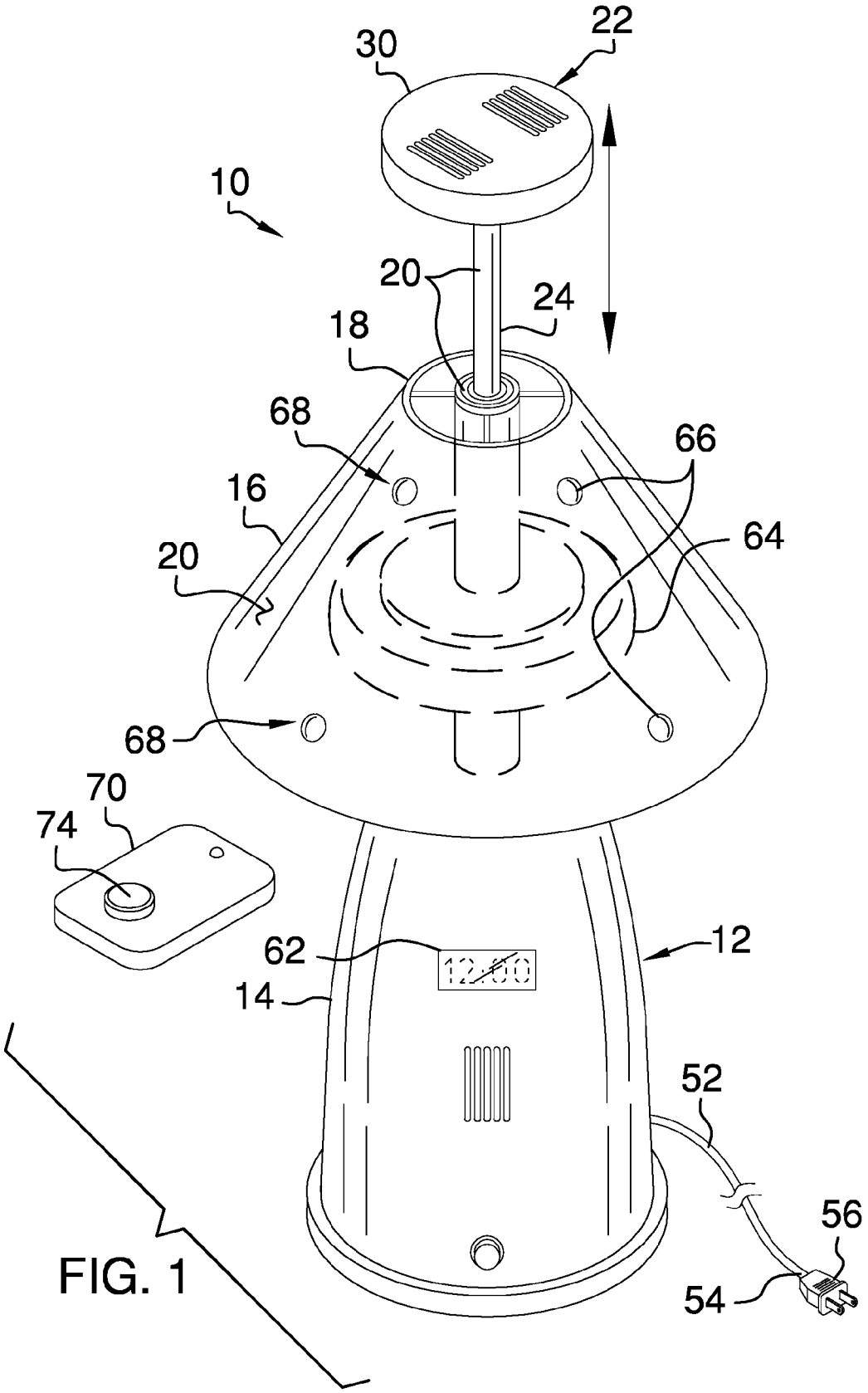
FIG. 1 is a top perspective view of a hazard detection assembly according to an embodiment of the disclosure.
Figure 2:
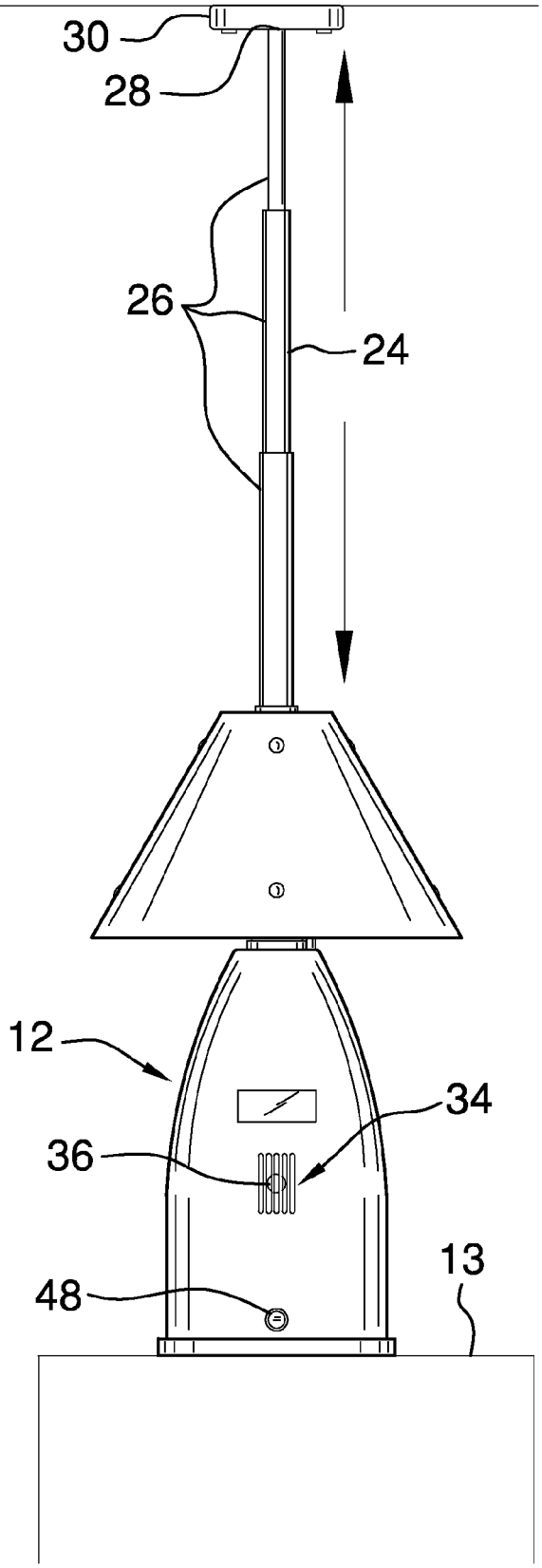
FIG. 2 is a perspective in-use view of an embodiment of the disclosure.
Figure 3:
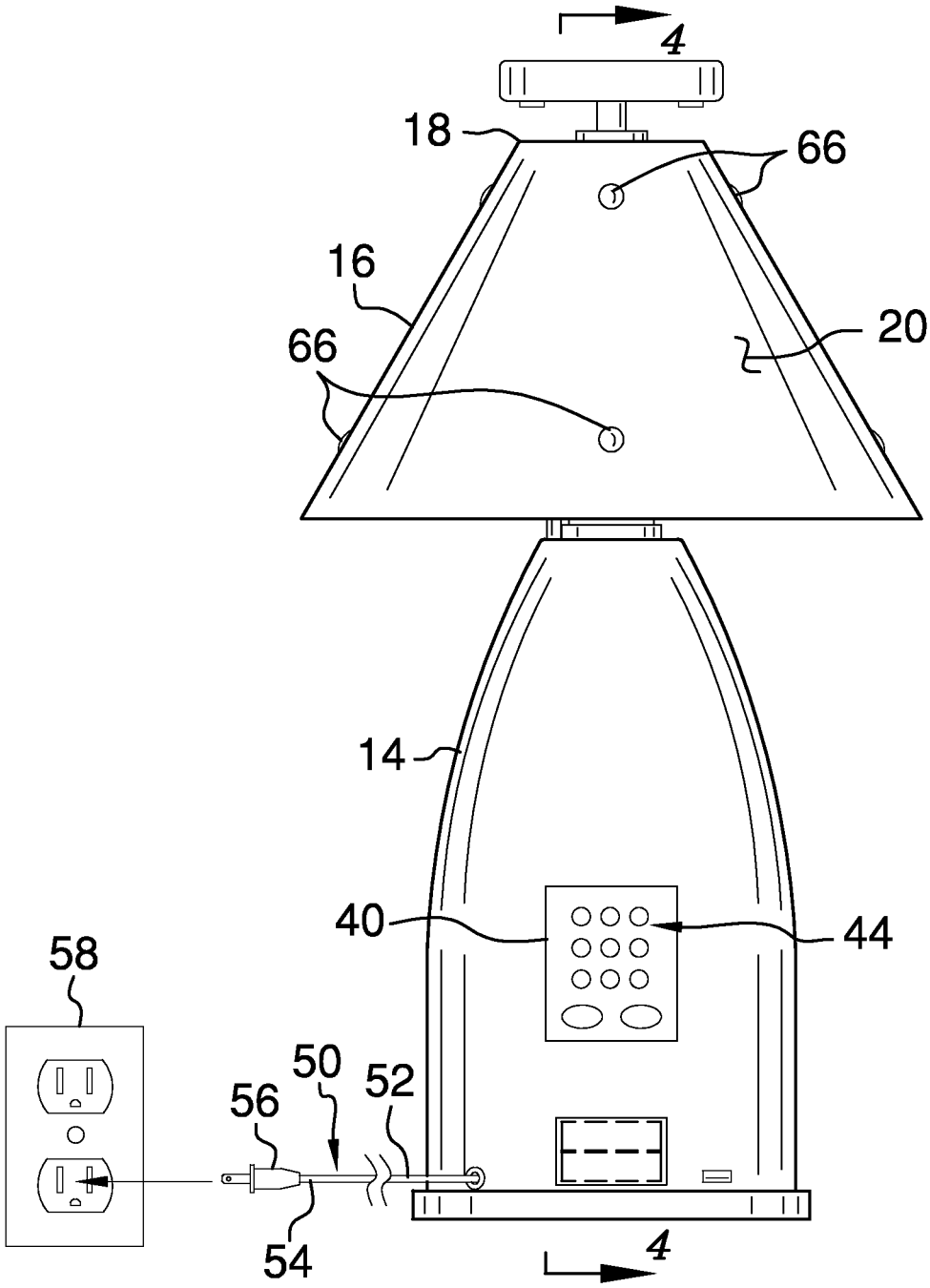
FIG. 3 is a back view of an embodiment of the disclosure.
Figure 4:
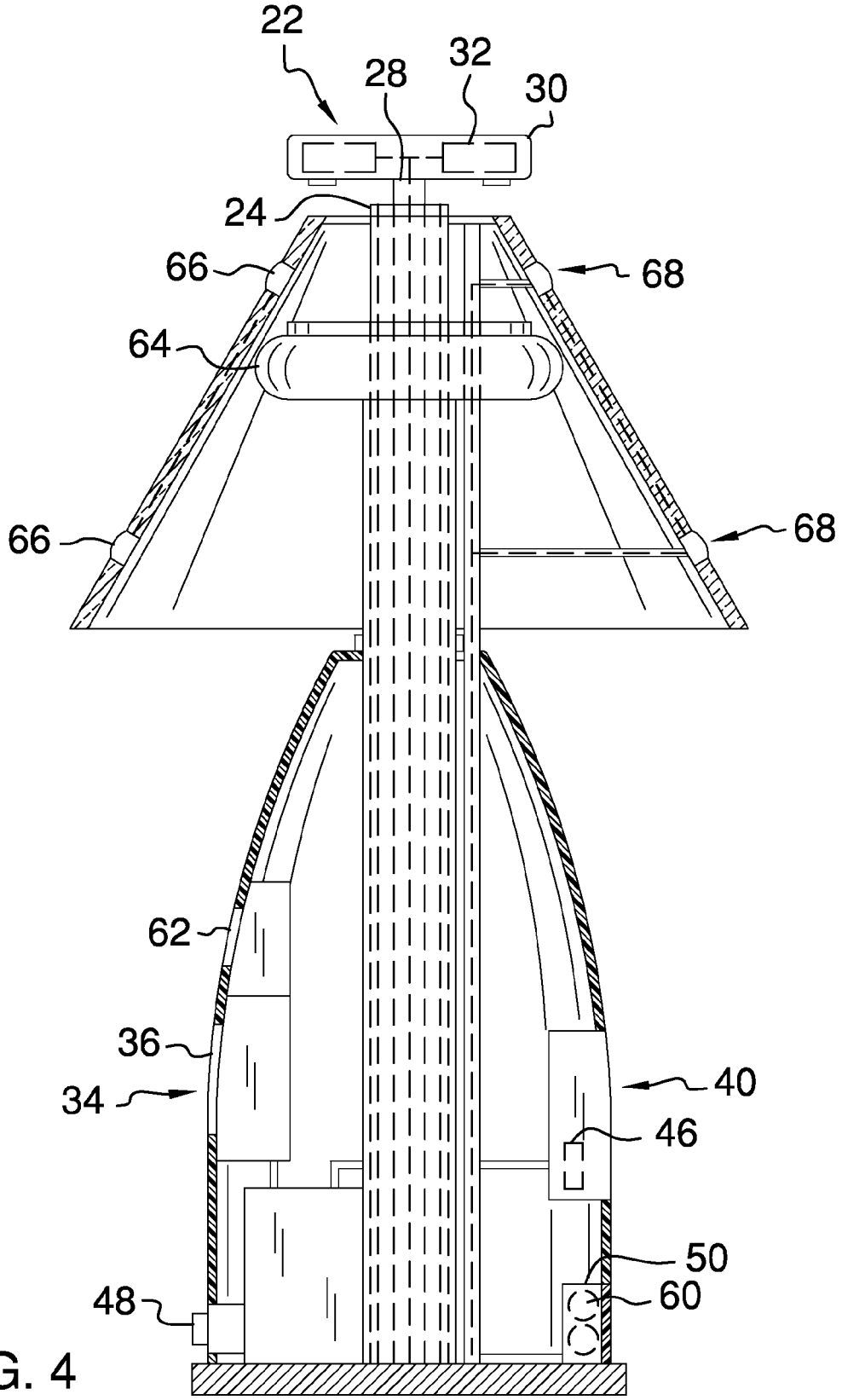
FIG. 4 is a cross sectional view taken along line 4-4 of FIG. 3 of an embodiment of the disclosure.
Figure 5:
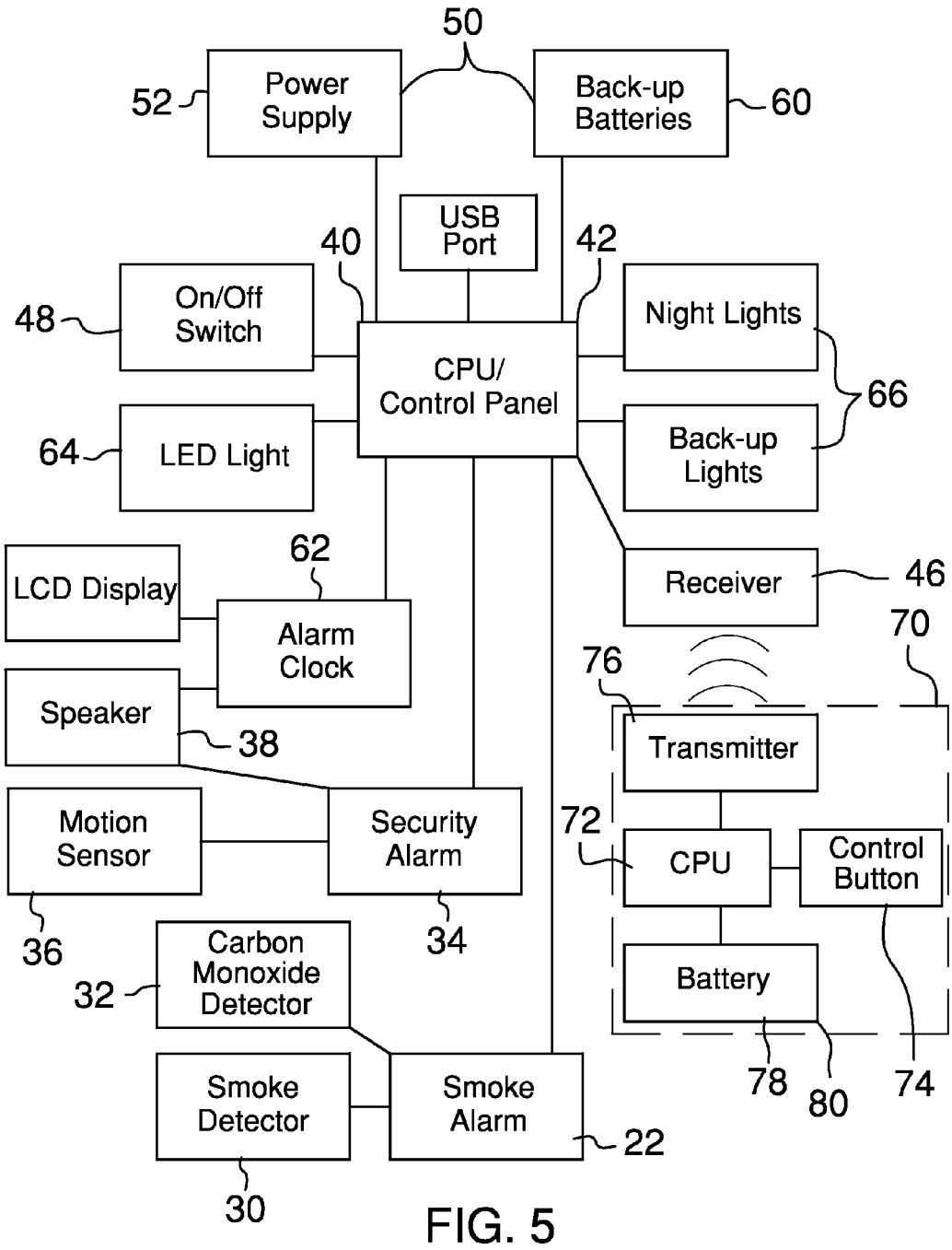
FIG. 5 is a schematic view of an embodiment of the disclosure.

With reference now to the drawings, and in particular to FIGS. 1 through 5 thereof, a new detection device embodying the principles and concepts of an embodiment of the disclosure and generally designated by the reference numeral 10 will be described.

As best illustrated in FIGS. 1 through 5, the hazard detection assembly 10 generally comprises a lamp 12 that may be positioned on a support surface 13. The lamp 12 has a body 14 and a shade 16. The shade 16 has a top end 18 and an outer surface 20. The support surface 13 may comprise a table or the like.

A smoke alert 22 is movably coupled to the lamp 12 and the smoke alert 22 is selectively extended from the lamp 12. The smoke alert 22 detects smoke and the smoke alert 22 issues an audible alarm when the smoke alert 22 detects the smoke. The smoke alert 22 comprises a rod 24 that is coupled to the lamp 12. The rod 24 extends through the body 14 and upwardly from the top end 18 of the shade 16. The rod 24 has a plurality of sections 26 that are slidably coupled together such that the rod 24 has a telescopically adjustable height. The rod 24 has a distal end 28 with respect to the top end 18.

A smoke detector 30 is coupled to the distal end 28. The smoke detector 30 is positionable in a deployed position having the smoke detector 30 being spaced from the top end 18. Thus, the smoke detector 30 may detect smoke. The smoke detector 30 is positionable in a stored position having the smoke detector 30 being positioned proximate the top end 18. The smoke detector 30 includes a carbon monoxide detector 32 and the carbon monoxide detector 32 detects carbon monoxide. The smoke detector 30 may comprise an electronic smoke detector or the like.

A security alert 34 is coupled to the lamp 12 and the security alert 34 detects motion. The security alert 34 issues an audible alarm when the security alert 34 detects the motion. The security alert 34 comprises a motion detector 36 that is coupled to the body 14. The motion detector 34 detects motion and the motion detector 34 may comprise a passive infrared motion detector or the like. A speaker 38 is coupled to the body 14 and the speaker 38 emits the audible alarm.

A control 40 is coupled to the lamp 12 and the control 40 may be manipulated. The control 40 is electrically coupled to the smoke alert 22 and the security alert 34. The control 40 controls operational parameters of the smoke alert 22 and the security alert 34. The control 40 comprises a base processor 42 that is positioned within the control 40. The base processor 42 is electrically coupled to the smoke detector 30, the carbon monoxide detector 32, the motion detector 36 and the speaker 38. Thus, the speaker 38 emits the audible alarm when the motion detector 36 detects motion, when the smoke detector 30 detects smoke and when the carbon monoxide detector 32 detects carbon monoxide.

The control 40 further comprised a keypad 44 that is coupled to the body 14 and the keypad 40 may be manipulated. The keypad 44 is electrically coupled to the base processor 42. A receiver 46 is positioned within the control 40 and the receiver 46 is electrically coupled to the base processor 42. The receiver 46 may comprise a radio frequency receiver or the like. A switch 48 is coupled to the body 14 and the switch 48 may be manipulated. The switch 48 is electrically coupled to the base processor 42 such that the switch 48 turns the base processor 42 on and off.

A base power supply 50 is positioned within the body 14 and the base power supply 50 is electrically coupled to the base processor 42. The base power supply 50 comprises a cord 52 extending outwardly from the body 14. The cord 52 has a distal end 54 with respect to the body 14 and the distal end 54 of the cord 52 has a plug 56 electrically coupled thereto.

The plug 56 may be electrically coupled to a power source 58. The power source 58 may comprise an electrical outlet or the like. The base power supply 50 further comprises at least one battery 60. The battery 60 provides electrical power when the power source 58 fails.

A clock 62 is coupled to the body 14 and the clock 62 is electrically coupled to the base processor 42. The clock 62 may comprise a digital alarm clock or the like. A first light emitter 64 is positioned around the rod 24 and the first light emitter 64 may illuminate an area. The first light emitter 64 is positioned within the shade 16 and the first light emitter 64 is electrically coupled to the base processor 42.

A plurality of second light emitters 66 is provided. Each of the second light emitters 66 is coupled to the outer surface 20 of the shade 16 such that each of the second light emitters 66 illuminates the area. Each of the second light emitters 66 is electrically coupled to the base processor 42. Each of the second light emitters 66 may comprise an LED or the like.

The plurality of second light emitters 66 is arranged into a pair of rows 68 and each of the rows 68 extends around the shade 16. The rows 68 are spaced apart from each other. The second light emitters 66 may be used for dim, nighttime lighting or the like. Additionally, the second light emitters 66 automatically illuminate when the power source 58 fails.

A remote control 70 is in electrical communication with security alert 34 such that the remote control 70 controls operational parameters of the security alert 34. The remote control 70 comprises a remote processor 72 that is positioned within the remote control 70. A button 74 is coupled to the remote control 70 and the button 74 may be manipulated. The button 74 is electrically coupled to the remote processor 72. The button 74 is manipulated to control the operational parameters of the motion detector 36.

A transmitter 76 is positioned within the remote control 70 and the transmitter 76 is electrically coupled to the remote processor 72. The transmitter 76 is in electrical communication with the receiver 46 thereby facilitating the button 74 to control operational parameters of the motion detector 36. The transmitter 76 may comprise a radio frequency transmitter or the like. A remote power supply 78 is positioned within the remote control 70. The remote power supply 78 is electrically coupled to the remote processor 72. The remote power supply 78 comprises at least one battery 80.

In use, the lamp 12 is positioned on the support surface 13 and the smoke detector 30 is positioned in the deployed position. The smoke detector 30 is positioned proximate a ceiling or the like thereby enhancing the smoke detector's 30 ability to detect smoke. The keypad 44 is manipulated to control operational parameters of the motion detector 36, the first light emitter 64, the second light emitters 66 and the clock 62. The speaker 38 emits the audible alarm when the motion detector 36 detects motion. Thus, the security alert 34 may alert a user to an intruder while the user is sleeping. The button 74 on the remote control 70 is manipulated to turn the security alert 34 on or off at any selected time. The lamp 12 is positioned within a dormitory room, a barracks room, a bedroom or other room used for housing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hazard detection assembly comprising:

a rod;

a shade;

a base processor;

a lamp being configured to be positioned on a support surface;

a smoke alert being movably coupled to said lamp, said smoke alert being selectively extended from said lamp wherein said smoke alert is configured to detect smoke, said smoke alert issuing an audible alarm when said smoke alert detects the smoke;

a security alert being coupled to said lamp wherein said security alert is configured to detect motion, said security alert issuing an audible alarm when said security alert detects the motion;

a control being coupled to said lamp wherein said control is configured to be manipulated, said control being electrically coupled to said smoke alert and said security alert such that said control controls operational parameters of said smoke alert and said security alert; and a remote control being in electrical communication with security alert such that said remote control controls operational parameters of said security alert, and a first light emitter being positioned around said rod wherein said first light emitter is configured to illuminate an area, said first light emitter being positioned within said shade, said first light emitter being electrically coupled to said base processor; and a plurality of second light emitters, each of said second light emitters being coupled to said outer surface of said shade wherein each of said second light emitters is configured to illuminate the area, each of said second light emitters being electrically coupled to said base processor.

2. The assembly according to claim 1, wherein:

said lamp has a body and a shade, said shade having a top end; and said smoke alert comprises a rod being coupled to said lamp, said rod extending through said body and upwardly from said top end of said shade, said rod having a plurality of sections being slidably coupled together such that said rod has a telescopically adjustable height, said rod having a distal end with respect to said top end.

3. The assembly according to claim 2, further comprising a smoke detector being coupled to said distal end, said smoke detector being positionable in a deployed position having said smoke detector being spaced from said top end wherein said smoke detector is configured to detect smoke, said smoke detector being positionable in a stored position having said smoke detector being positioned proximate said top end.

4. The assembly according to claim 1, wherein:

said lamp has a body; and said security alert comprises a motion detector being coupled to said body wherein said motion detector is configured to detect motion.

5. The assembly according to claim 4, further comprising:

a smoke detector; and a speaker being coupled to said body wherein said speaker is configured to emit the audible alarm, said speaker emitting the audible alarm when said motion detector detects motion and when said smoke detector detects smoke.

6. The assembly according to claim 1, wherein:

said lamp includes a body;

said smoke alert includes a smoke detector;

said security alert includes a motion detector and a speaker;

said control comprises a base processor being positioned within said control, said base processor being electrically coupled to said smoke detector, said motion detector and said speaker; and a keypad being coupled to said body wherein said keypad is configured to be manipulated, said keypad being electrically coupled to said base processor.

7. The assembly according to claim 6, further comprising:

a receiver being positioned within said control, said receiver being electrically coupled to said base processor; and a switch being coupled to said body wherein said switch is configured to be manipulated, said switch being electrically coupled to said base processor such that said switch turns said base processor on and off.

8. The assembly according to claim 6, further comprising a base power supply being positioned within said body, said base power supply being electrically coupled to said base processor, said base power supply comprising a cord extending outwardly from said body, said cord having a distal end with respect to said body, said distal end of said cord having a plug being electrically coupled thereto, said plug being configured to be electrically coupled to a power source, said base power supply further comprising at least one battery, said battery providing electrical power when the power source fails.

9. The assembly according to claim 6, further comprising a clock being coupled to said body, said clock being electrically coupled to said base processor.

10. The assembly according to claim 1, wherein said remote control comprises:

a remote processor being positioned within said remote control; and a button being coupled to said remote control wherein said button is configured to be manipulated, said button being electrically coupled to said remote processor.

11. The assembly according to claim 10, further comprising:

a receiver; and a motion detector; and a transmitter being positioned within said remote control, said transmitter being electrically coupled to said remote processor, said transmitter being in electrical communication with said receiver such that said button controls operational parameters of said motion detector.

12. The assembly according to claim 11, further comprising a remote power supply being positioned within said remote control, said remote power supply being electrically coupled to said remote processor, said remote power supply comprising at least one battery.

13. A hazard detection assembly comprising:

a lamp being configured to be positioned on a support surface, said lamp having a body and a shade, said shade having a top end and an outer surface;

a smoke alert being movably coupled to said lamp, said smoke alert being selectively extended from said lamp wherein said smoke alert is configured to detect smoke, said smoke alert issuing an audible alarm when said smoke alert detects the smoke, said smoke alert comprising:

a rod being coupled to said lamp, said rod extending through said body and upwardly from said top end of said shade, said rod having a plurality of sections being slidably coupled together such that said rod has a telescopically adjustable height, said rod having a distal end with respect to said top end, and a smoke detector being coupled to said distal end, said smoke detector being positionable in a deployed position having said smoke detector being spaced from said top end wherein said smoke detector is configured to detect smoke, said smoke detector being positionable in a stored position having said smoke detector being positioned proximate said top end;

a security alert being coupled to said lamp wherein said security alert is configured to detect motion, said security alert issuing an audible alarm when said security alert detects the motion, said security alert comprising:

a motion detector being coupled to said body wherein said motion detector is configured to detect motion, and a speaker being coupled to said body wherein said speaker is configured to emit the audible alarm, said speaker emitting the audible alarm when said motion detector detects motion and when said smoke detector detects smoke;

a control being coupled to said lamp wherein said control is configured to be manipulated, said control being electrically coupled to said smoke alert and said security alert such that said control controls operational parameters of said smoke alert and said security alert, said control comprising:

a base processor being positioned within said control, said base processor being electrically coupled to said smoke detector, said motion detector and said speaker, a keypad being coupled to said body wherein said keypad is configured to be manipulated, said keypad being electrically coupled to said base processor, a receiver being positioned within said control, said receiver being electrically coupled to said base processor, a switch being coupled to said body wherein said switch is configured to be manipulated, said switch being electrically coupled to said base processor such that said switch turns said base processor on and off, a base power supply being positioned within said body, said base power supply being electrically coupled to said base processor, said base power supply comprising a cord extending outwardly from said body, said cord having a distal end with respect to said body, said distal end of said cord having a plug being electrically coupled thereto, said plug being configured to be electrically coupled to a power source, said base power supply further comprising at least one battery, said battery providing electrical power when the power source fails;

a clock being coupled to said body, said clock being electrically coupled to said base processor;

a first light emitter being positioned around said rod wherein said first light emitter is configured to illuminate an area, said first light emitter being positioned within said shade, said first light emitter being electrically coupled to said base processor;

a plurality of second light emitters, each of said second light emitters being coupled to said outer surface of said shade wherein each of said second light emitters is configured to illuminate the area, each of said second light emitters being electrically coupled to said base processor; and a remote control being in electrical communication with security alert such that said remote control controls operational parameters of said security alert, said remote control comprising:

a remote processor being positioned within said remote control, a button being coupled to said remote control wherein said button is configured to be manipulated, said button being electrically coupled to said remote processor, a transmitter being positioned within said remote control, said transmitter being electrically coupled to said remote processor, said transmitter being in electrical communication with said receiver such that said button controls operational parameters of said motion detector, and a remote power supply being positioned within said remote control, said remote power supply being electrically coupled to said remote processor, said remote power supply comprising at least one battery.

* * * * *